US008220887B2

(12) United States Patent
Watts et al.

(10) Patent No.: US 8,220,887 B2
(45) Date of Patent: Jul. 17, 2012

(54) SELECTABLE PRESENTATION OF DUAL-BIN SYSTEM

(75) Inventors: Russell Watts, Starr, SC (US); James S. Fowler, Jr., Liberty, SC (US); Christian P. Detlefsen, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 12/580,759

(22) Filed: Oct. 16, 2009

(65) Prior Publication Data

US 2010/0219730 A1 Sep. 2, 2010

Related U.S. Application Data

(63) Continuation of application No. 12/394,062, filed on Feb. 27, 2009, now abandoned.

(51) Int. Cl.
*A47B 96/04* (2006.01)

(52) U.S. Cl. ..... 312/402; 312/404

(58) Field of Classification Search ..... 312/402, 312/404, 191, 319.5–319.8, 301, 298, 299, 312/312, 306

See application file for complete search history.

(56) References Cited

U.S. PATENT DOCUMENTS

| | | | | |
|---|---|---|---|---|
| 2,711,944 | A * | 6/1955 | Meek et al. | 312/333 |
| 2,919,691 | A * | 1/1960 | Rinaldo et al. | 126/337 A |
| 3,043,290 | A * | 7/1962 | Smith | 126/337 A |
| 3,976,000 | A * | 8/1976 | Oxel | 99/446 |
| 5,299,863 | A | 4/1994 | Albright, Jr. | |
| 5,429,043 | A * | 7/1995 | Becker | 99/448 |
| 5,980,009 | A | 11/1999 | Atalla et al. | |
| 6,467,285 | B2 | 10/2002 | Felder et al. | |
| 6,523,919 | B1 | 2/2003 | Israelsen et al. | |
| 6,663,204 | B2 | 12/2003 | Atalla et al. | |
| 6,915,657 | B1 | 7/2005 | Wood | |
| 6,971,730 | B2 | 12/2005 | Koons | |

(Continued)

FOREIGN PATENT DOCUMENTS

JP 4045382 2/1992

(Continued)

OTHER PUBLICATIONS

International Search Report for International Application No. PCT/US2010/024703 mailed on Sep. 14, 2010, 2 pages.

*Primary Examiner* — Darnell Jayne
*Assistant Examiner* — Andres F Gallego
(74) *Attorney, Agent, or Firm* — Pearne & Gordon LLP

(57) ABSTRACT

A refrigerator is provided that includes a compartment, a first container, a second container, a door, and a selection device. The first container is located in the compartment and configured to be movable in a first direction. The second container is located in the compartment and configured to be movable in the first direction. The door is operably connected to the second container and configured to provide access to at least one of the first container and the second container of the compartment when the door is moved to an open position. The door is also configured to inhibit access to the compartment when the door is moved to a closed position. The selection device is located on the refrigerator and configured for inputting a selection of either the first container or the second container. The selected container is presented in an accessible position when the door is moved from the closed position to the open position.

20 Claims, 7 Drawing Sheets

U.S. PATENT DOCUMENTS

| | | | | |
|---|---|---|---|---|
| 2005/0017607 | A1 * | 1/2005 | Weinberger | 312/215 |
| 2005/0073225 | A1 | 4/2005 | Kwon et al. | |
| 2006/0042303 | A1 * | 3/2006 | Oh et al. | 62/407 |
| 2006/0042304 | A1 * | 3/2006 | Oh et al. | 62/407 |
| 2006/0196198 | A1 | 9/2006 | Kim et al. | |
| 2006/0207283 | A1 | 9/2006 | Kim et al. | |
| 2006/0242988 | A1 | 11/2006 | Kim et al. | |
| 2006/0266070 | A1 | 11/2006 | Ertz et al. | |
| 2006/0290248 | A1 * | 12/2006 | Chandler | 312/312 |
| 2007/0245762 | A1 * | 10/2007 | Maglinger et al. | 62/344 |
| 2008/0018215 | A1 * | 1/2008 | Carden et al. | 312/404 |

FOREIGN PATENT DOCUMENTS

| | | |
|---|---|---|
| KR | 20080101335 | 11/2008 |
| WO | WO 0171263 A1 * | 9/2001 |
| WO | 2008111817 | 9/2008 |

* cited by examiner

SELECTABLE PRESENTATION OF DUAL-BIN SYSTEM

This application is a CONTINUATION of application Ser. No. 12/394,062 filed Feb. 27, 2009, which is now Abandoned.

FIELD OF THE INVENTION

The present invention relates generally to storage compartments, and more particularly, to a storage system for an appliance that includes multiple containers where any container can be selected for presentation.

BACKGROUND OF THE INVENTION

Appliances, such as refrigerators, typically include storage compartments. In a bottom mount style refrigerator, a freezer located in a bottom compartment can include two containers, such as a first container and a second container. The first container can be an upper container and the second container can be a lower container. Current automated door opening designs exist, but only for providing the presentation of the lower container.

A method and apparatus for selectable presentation of either container is desired. A method and apparatus that can be used with many different appliances and different storage compartments is also desired.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a refrigerator is provided that includes a compartment, a first container, a second container, a door, and a selection device. The first container is located in the compartment and configured to be movable in a first direction. The second container is located in the compartment and configured to be movable in the first direction. The door is operably connected to the second container and configured to provide access to at least one of the first container and the second container of the compartment when the door is moved to an open position. The door is also configured to inhibit access to the compartment when the door is moved to a closed position. The selection device is located on the refrigerator and configured for inputting a selection of either the first container or the second container. The selected container is presented in an accessible position when the door is moved from the closed position to the open position.

In accordance with another aspect of the present invention, a refrigerator is provided that includes a compartment, a first container, a second container, a door, a selection device, and at least one engagement member. The first container is located in the compartment and configured to be movable in a first direction. The second container is located in the compartment and configured to be movable in the first direction and a second direction. The door is operably connected to the second container and configured to provide access to at least one of the first container and the second container of the compartment when the door is moved to an open position.

The door is also configured to inhibit access to the compartment when the door is moved to a closed position. The selection device is located on the refrigerator and is configured to input a selection of either the first container or the second container. The selected container is presented in an accessible position when the door is moved from the closed position to the open position. The at least one engagement member is located on the second container. The at least one engagement member is configured for selectively engaging the first container to pull the first container out of the compartment to move the first container into the accessible position.

In accordance with another aspect of the present invention, a refrigerator is provided that includes a compartment, a first container, a second container, a door, and a selection device. The first container is located in the compartment and configured to be movable in a first direction. The second container is located in the compartment and configured to be movable in the first direction. The door is operably connected to the second container and configured to provide access to at least one of the first container and the second container of the compartment when the door is moved to an open position. The door is also configured to inhibit access to the compartment when the door is moved to a closed position. The selection device is located on the refrigerator and is configured to input a selection of either the first container or the second container. The selected container is presented in an accessible position when the door is moved to the open position. The door is movable in the first direction when moving from the closed position to the open position. The second container is movable with the door upon moving the door into the open position. The selection device includes a latch located on the first container and the latch is configured to be selectively activated to engage the door. Activation of the latch causes the first container to also be movable with the door when the door moves from the closed position into the open position.

In accordance with another aspect of the present invention, a method is provided for selecting one container in a compartment of a refrigerator and automatically moving the selected container to an accessible position comprising. The method includes the step of providing a selection device to input a selection of either a first container or a second container. The method also includes the step of moving a door to the compartment from a closed position to an open position wherein the selected container is in the accessible position when the door reaches the open position.

BRIEF DESCRIPTION OF THE SEVERAL VIEWS OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
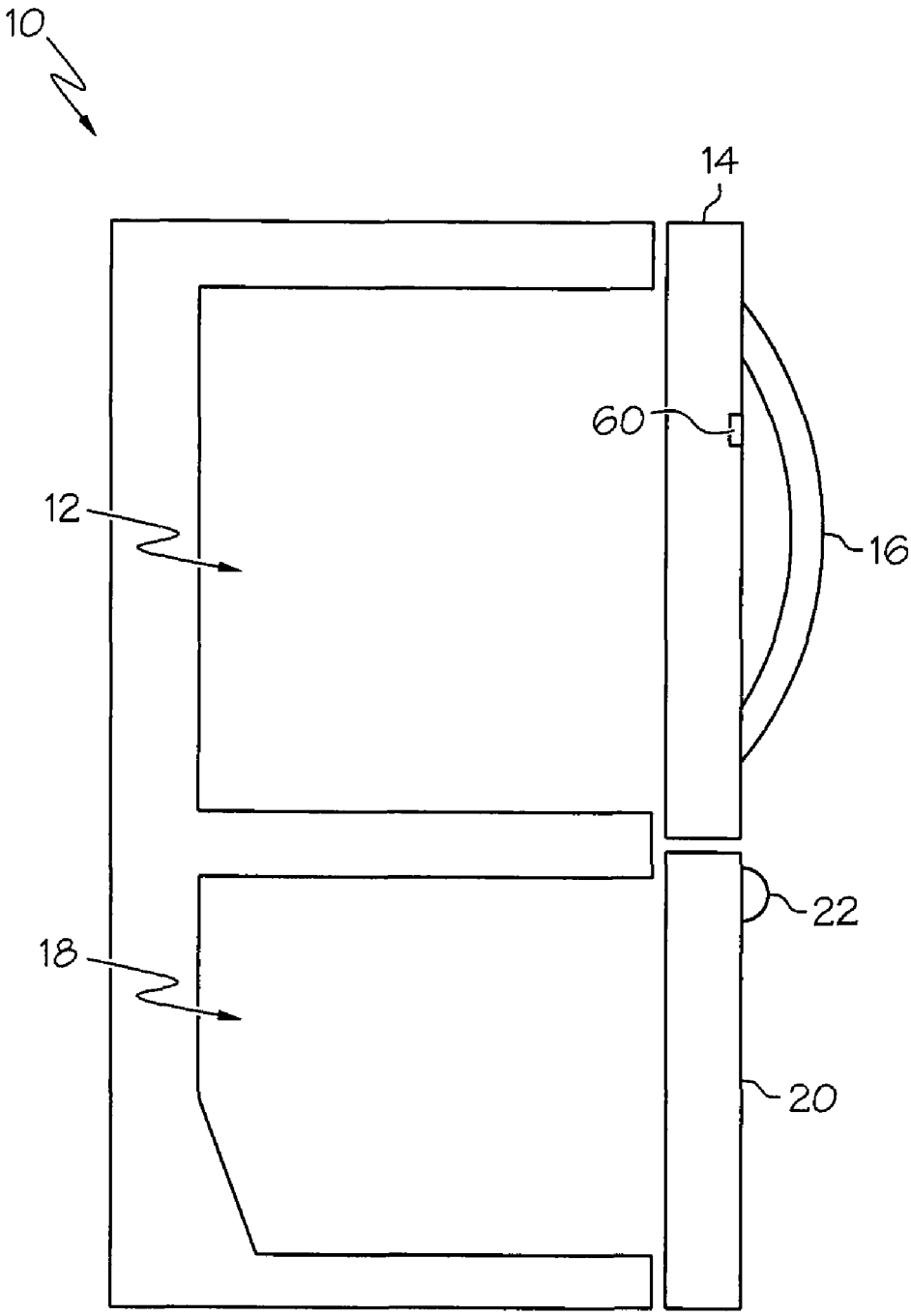
FIG. 1 is a side view of an example refrigerator.

Examples that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Turning to the shown example of FIG. 1, an example storage compartment in an appliance is provided. The shown example is a refrigerator-freezer 10. It is appreciated that other sizes, styles, and configurations of a refrigerator-freezer 10 are contemplated for use with the subject invention. It is also appreciated that the storage compartment can be used for other appliances such as dishwashers, washers, driers, ovens, stoves, etc. The refrigerator-freezer 10 in this example includes an upper compartment 12 and a lower compartment 18. The upper compartment 12, which in one example can be a refrigerator compartment, includes an upper compartment door 14 and an upper compartment door handle 16. The lower compartment 18, which in one example can be a freezer compartment, includes a lower compartment door 20 and a lower compartment door handle 22. The lower compartment door handle 22 is shaped for a user of the appliance to pull the door 20 away from the refrigerator-freezer 10. Other shapes can be used for the lower compartment door handle 22, as well as the upper compartment door handle 16. The upper compartment door 14 and the lower compartment door 20 can be doors that are attached by hinges in other examples. The refrigerator-freezer 10 can also include a selection device 60. In the example of FIG. 1, the selection device 60 is located on the upper compartment door 14.

In the examples of FIGS. 2-13, the lower compartment 18 of FIG. 1 is shown. A first example is shown in FIGS. 2-9 and a second example is shown in FIGS. 10-13. It is appreciated that the storage compartment apparatus of either example can be used in any compartment located in any appliance. Thus, for example, either example can be used in the upper compartment 12 or the lower compartment 18 of the example refrigerator-freezer. Furthermore, any of the examples can be used in appliances with side-by-side compartments, or other configurations.

Figure 2:
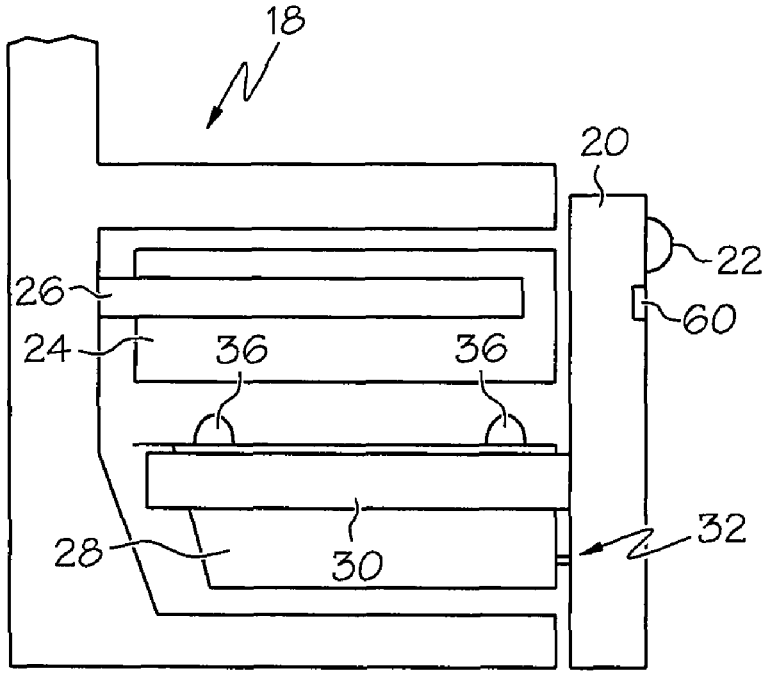
FIG. 2 is a partial view of FIG. 1 that includes a first example of the subject invention with the second container in an original resting position.

In the first example, the lower compartment 18 in FIG. 2 includes a first container 24 and a second container 28 located within the compartment. The first container 24 can be an upper container and the second container 28 can be a lower container, meaning that the second container 28 can be located below the first container 24. In other examples, the first container 24 can be located in different locations relative to the second container 28, such as the first container 24 being located side-by-side with the second container 28 or the first container 24 being located at different vertical and horizontal distances from the second container 28. In FIG. 2, the second container 28 is in an original resting position.

The first container 24 is configured to be movable in a first direction. The first direction can be a horizontal direction, though other directions such as a vertical, a diagonal, or a curved line of direction can be used. The second container 28 is configured to be moveable in the first direction but can also be configured to be moveable in a second direction. In the example of FIG. 2, the first direction that the first container 24 and the second container 28 are moveable in is horizontal, as seen when comparing FIG. 2 and FIG. 5 as the first container 24 and the second container 28 are moved horizontally out of the lower compartment 18. The second direction that the second container 28 can be moveable in is vertical, as seen when comparing FIG. 2 and FIG. 3 when the second container 28 moves vertically into engagement with the first container 24. In another example, the second direction can be a horizontal direction while the first direction is a vertical direction. In another example, the second direction can be a diagonal line of direction and the first direction can be a different diagonal line of direction. In yet another example, the first direction and the second direction can be different curved lines of direction. In further examples, the first direction and the second direction can each be any line of direction, such as a vertical, a diagonal, or a curved line of direction.

As seen in FIG. 2, the first container 24 can be operably connected to a first set of rails 26, such as a set of slide rails. The first container 24 in this example is movable in the first direction along the first set of rails 26. The first set of rails 26 are connected to the sidewalls of the lower compartment 18. The second container 28 is movable in the first direction along a second set of rails 30, such as a set of slide rails. The second set of rails 30 can also be connected to the sidewalls of the lower compartment 18. In the example of FIG. 2, the first set of rails 26 and the second set of rails 30 allow horizontal movement of the first container 24 and the second container 28. In other examples, the first set of rails 26 and the second set of rails 30 can be oriented in varying directions to allow varying directional movements.

Figure 3:
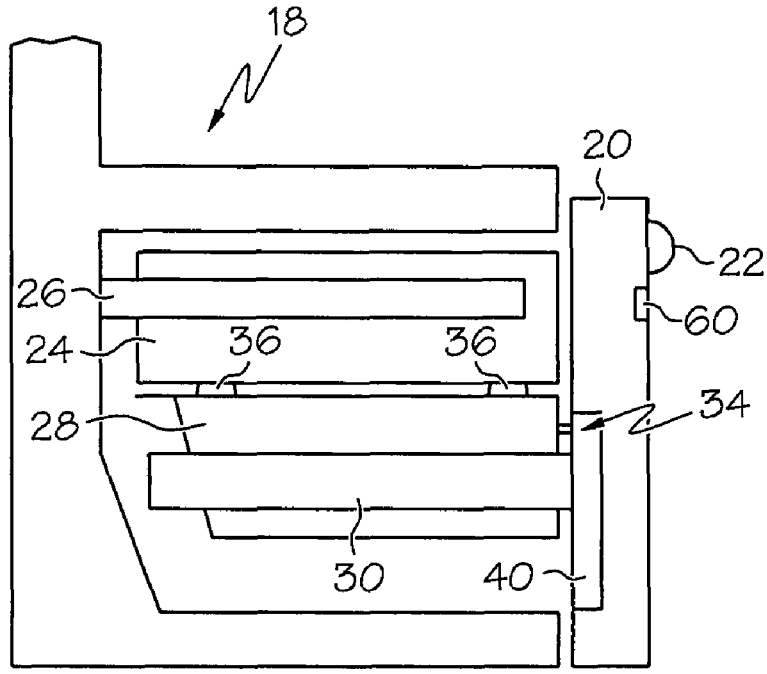
FIG. 3 is a partial view of FIG. 1 that includes the first example with the second container in a raised position.
Figure 4:
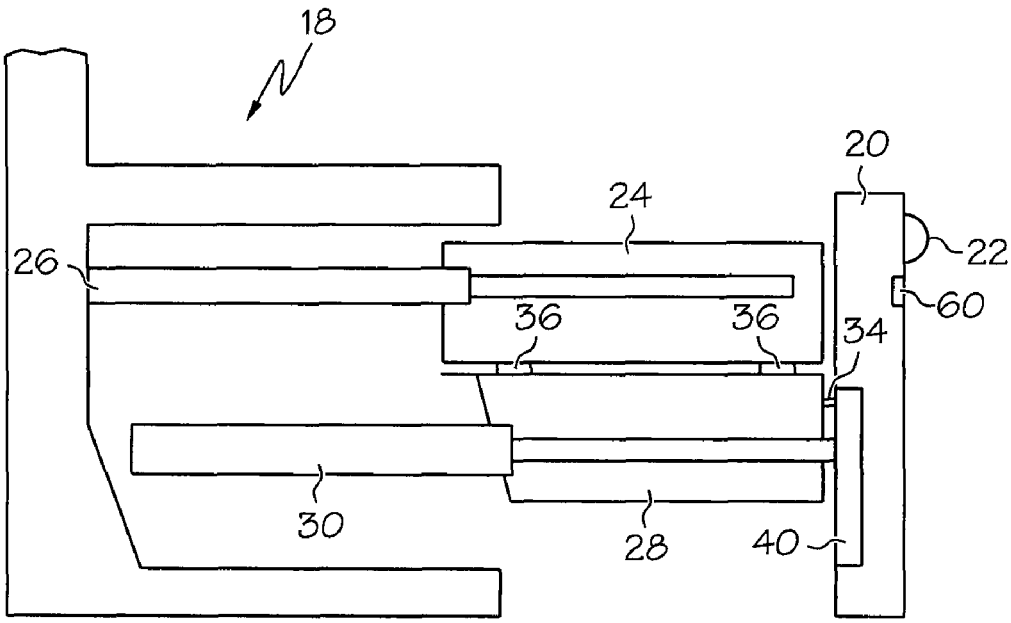
FIG. 4 is a view similar to FIG. 2 with the door in an open position and the second container in a raised position.

The lower compartment door 20, seen in FIG. 2, is configured to provide access to at least one of the first container 24 and the second container 28 of the lower compartment 18 when the lower compartment door 20 is in an open position (FIGS. 4, 5, 7-9). The lower compartment door 20 is also configured to inhibit access to the first container 24, the second container 28, and the lower compartment 18 when the lower compartment door 20 is in a closed position (FIGS. 2-3). When the lower compartment door 20 is in the closed position, this inhibits access to the containers and the compartment as the containers and the compartment cannot be physically accessed by a user. The lower compartment door 20 can be movable in the first direction when moving from the closed position to the open position. The first direction of movement for the compartment door 20 can be a horizontal direction, though other directions such as a vertical, a diagonal, or a curved line of direction can be used. The second container 28 can be integrally formed with the lower compartment door 20. For example, one of the walls of the second container 28 can be the inner surface of the lower compartment door 20. Alternatively, the second container 28 can be operably connected to the door 20 for the second container 28 to move in the first direction along with the door 20. The second container 28 can be operably connected to the door by the use of at least one attachment member. In the example of FIG. 2, a first attachment member 32 is visible. In FIG. 4, a second attachment member 34 is visible and can also be provided, while the first attachment member 32 is still present but is located behind the second set of rails 30 in this view. The first attachment member 32 and the second attachment member 34 are used to connect the second container 28 to the door 20. The second container 28 is operably connected to the door 20 for the second container 28 to move in the first direction, such as horizontally, along with the door 20.

Figure 5:
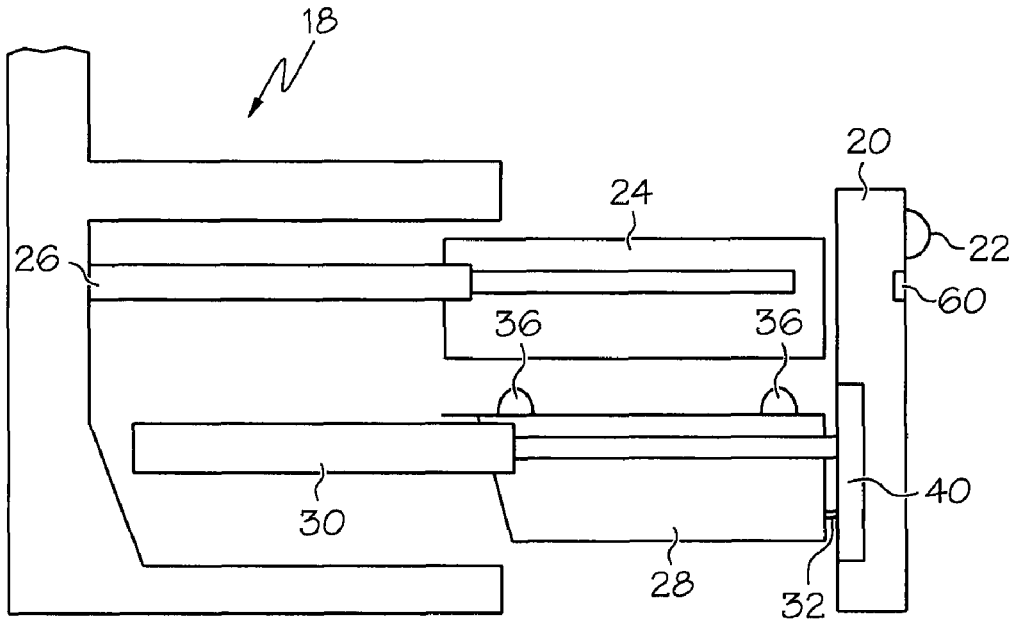
FIG. 5 is a view similar to FIG. 5 with the door in an open position and the second container in the resting position.
Figure 6:
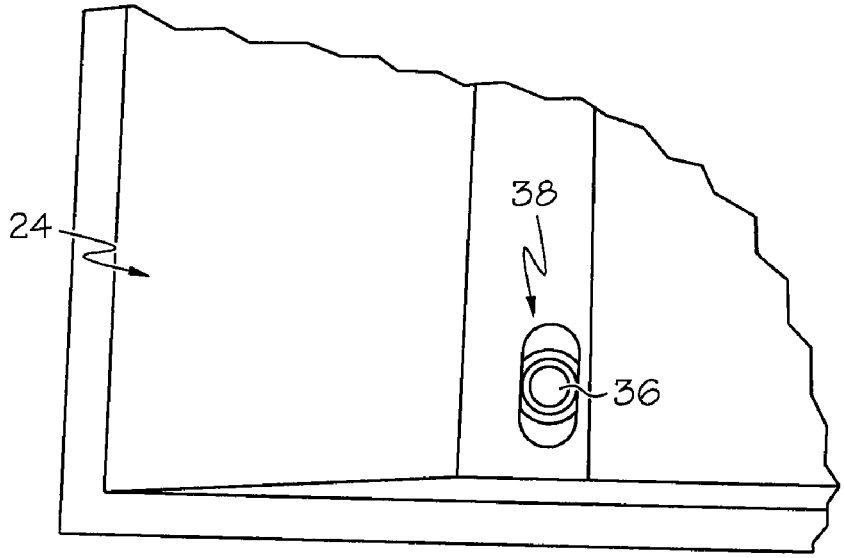
FIG. 6 is a top view of the first container of FIGS. 2-5 with an engagement member of the second container engaging the first container.
Figure 7:
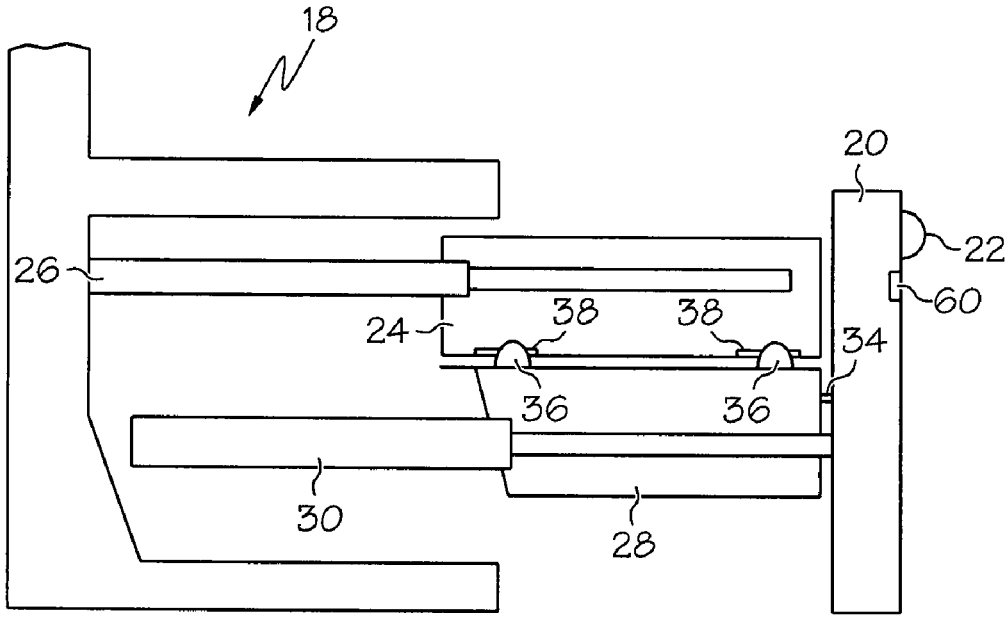
FIG. 7 is a sectional view of FIG. 4 showing an engagement member engaging a slot in the first container.
Figure 8:
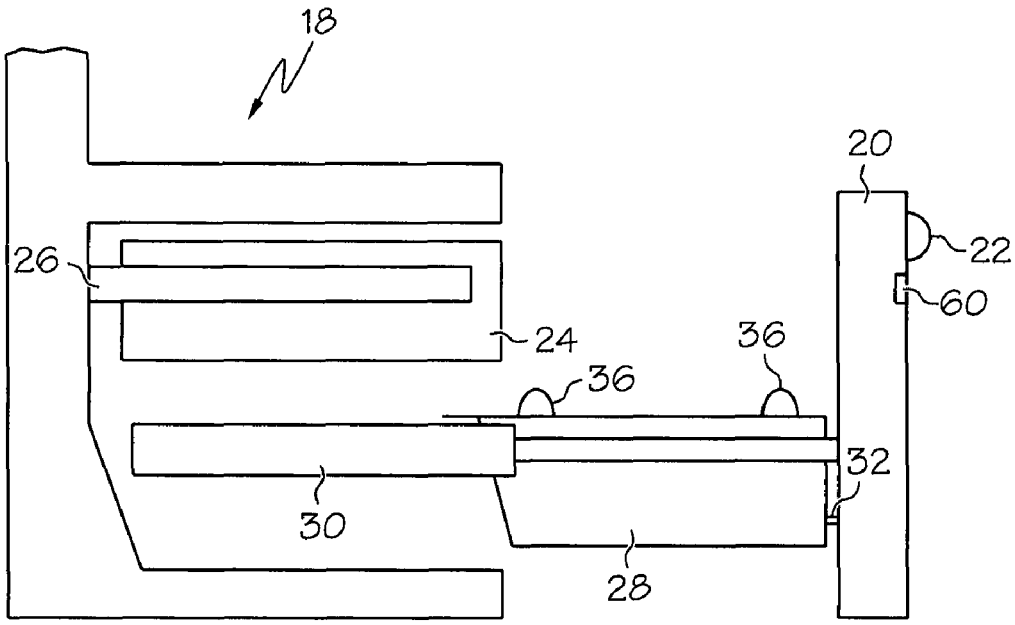
FIG. 8 is a view similar to FIG. 5 with the door in an open position and the first container in a position inside the compartment.
Figure 9:
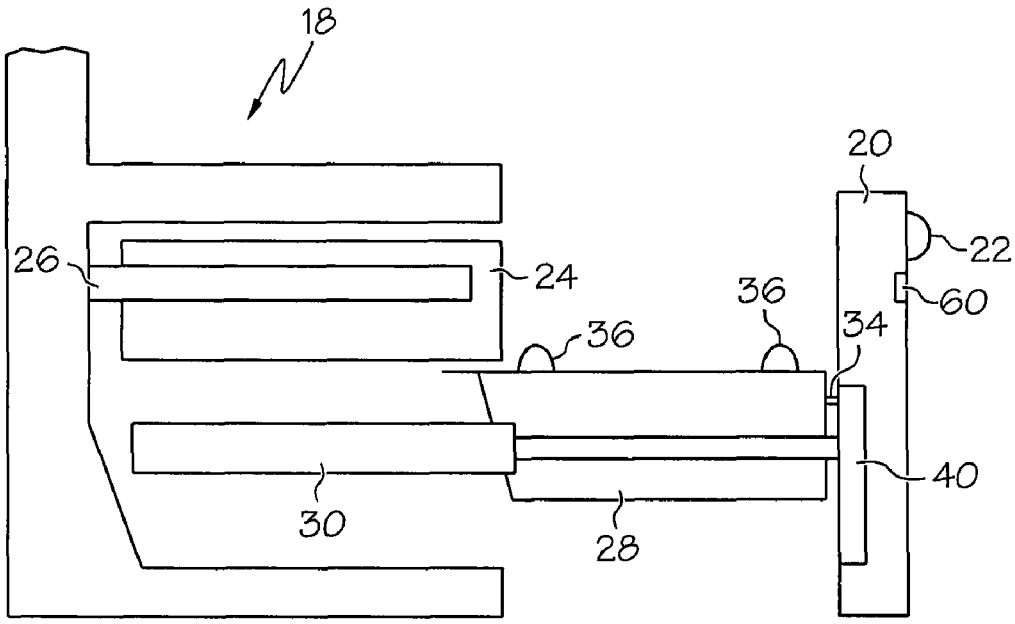
FIG. 9 is a view similar to FIG. 5 with the door in an open position, the first container in a position inside the compartment, and the second container in a raised position.

In the example of FIG. 2, a selection of either the first container 24 or the second container 28 while the door 20 is in the closed position, can be made where the selected container is presented in an accessible position. The accessible position of a container is a position where the user can physically move or remove items from the container, as the container is at least partially moved outwards from its compartment, and the door is in an open position. One example of an accessible position for the first container 24 is shown in FIG. 4 and FIG. 5. One example of an accessible position for the second container 28 is shown in FIG. 8 and FIG. 9. The selection of either container can be made while the door 20 is in the closed position. The selection device 60 is configured for inputting a selection of either the first container 24 or the second container 28 to present the selected container in an accessible position. In the example of FIGS. 2-13, the selection device 60 is located on the lower compartment door 20. In other examples, the selection device 60 can be in other locations and additional containers can also be provided in other examples.

The selection device 60 can be located on any portion of the appliance. The selection device 60 can be located on the upper compartment door 14, as seen in FIG. 1, or the lower compartment door 20, as seen in FIGS. 2-13. The selection device 60 can include a control panel that can be located on any portion of the refrigerator-freezer 10. In one example, the selection device 60 can be placed upon an exterior portion of a refrigerator to provide improved accessibility of the selection device 60. The selection device 60 can also be a button, a lever, a mechanical switch, or other structure that can be selectively activated. The selection of a container can be inputted to the refrigerator-freezer 10 through the button, the lever, or the mechanical switch being placed into a position corresponding to a specific container being presented in an accessible position.

Once the selection of a container is inputted to the refrigerator through the selection device 60, the selection device 60 can trigger an automatic movement of the lower compartment door 20 to an open position in one example through the control of a motor to open and close the lower compartment door 20. Upon the door reaching the open position, either by automatic or manual opening of the door, a selected container (e.g. first container 24 or second container 28) will be presented automatically to the user in an accessible position. In the examples shown, the lower compartment door 20 is pulled outwards with the selected container in an accessible position. In other examples, a door may open in other manners, such as a door connected on a hinge, where the selected container can be automatically moved out of the lower compartment 18 of the appliance automatically upon the door being opened.

In the example of FIG. 2, the second container 28 is configured to be move with the lower compartment door 20. If the first container 24 is the selection in this example, the second container 28 can move in a second direction, such as vertically, into engagement with the first container 24, as shown in FIG. 3. In the example of FIG. 3, the second container 28 is movable from the original resting position of FIG. 2, to a raised position of FIG. 3. It is appreciated that the raised position can also mean a different position along the second direction. The second container 28 is placed in engagement with the first container 24 when the second container 28 reaches the raised position of FIG. 3. In the example of FIG. 2 and FIG. 3, at least one engagement member 36 is provided, located on the second container. The second container 28 is placed in engagement with the first container 24 while the door 20 is in the closed position. The engagement member 36 selectively engages the first container 24 to pull the first container 24 out of the lower compartment 18 to place the first container 24 in an accessible position upon the lower compartment door 20 being placed in the open position. The engagement member 36 of the second container 28 selectively engages the first container 24 when the first container 24 is the selection. The second container 28 can automatically engage the engagement member 36 with the first container 24 upon the selection of the first container 24 at the selection device 60. The distance that the second container 28 travels in the second direction can be controlled by a variety of methods such as by providing a limit switch, timing the movement, or providing motor encoder feedback.

The second container 28 can be moved in the second direction, between FIG. 2 and FIG. 3 through the use of a lifting device 40 which can be automatically activated upon the selection of a container at the selection device 60. In this example, when the second container 28 is selected, the door 20 can move automatically to the open position and the lifting device 40 can then move the second container 28 along a second direction which in this example is a vertical direction. The lifting device 40 can also move the second container 28 in a second direction that can also be a horizontal direction, a diagonal line of direction, or a curved line of direction. The lifting device 40 can include a track to move each attachment member 32, 34 along the inner surface of the door 20. The lifting device 40 can include a motor configured to move at least one attachment member 32, 34 or other structure operably connecting the second container 28 to the door 20. It is appreciated that the same lifting device 40 can be used in any of the figures, but it is shown in FIGS. 3-5 for example purposes. The lifting device 40 in FIG. 3 shows one range of motion for the second container 28, though it is appreciated that the lifting device 40 can also be capable of moving the second container 28 along the entire length of the lower compartment door 20.

The door 20 is movable in the first direction from the closed position of FIG. 3 to the open position of FIG. 4. In this example, the first direction is a direction of horizontal travel, though in other examples, the door 20 can be operated in various directions. The second container 28 is movable outside of the lower compartment 18 due to the second container 28 being operably connected to the door. In this example, the engagement members 36 of the second container 28 engage the first container 24 to cause the first container 24 to move outside of the lower compartment 18 along with the second container 28 that is operably connected to the door 20. Thus, the first container 24 and the second container 28 are movable with the door 20 upon moving the door 20 into the open position, the first container 24 being in an accessible position and inhibiting access to the second container 28. The accessible position is defined as the selected container extended outward from the compartment.

The second container 28 can be movable in the second direction from the raised position of FIG. 4 to return to the original resting position upon the door 20 reaching the open position, as seen in FIG. 5. In FIG. 5, the second container 28 is lowered and moved out of engagement from the first container 24. The movement of the second container 28 allows a user to manually move the first container 24, as desired, in the first direction when the door 20 is in the open position. FIG. 8 shows an example of when the first container 24 is moved back into the lower compartment. Movement along a reverse first direction allows the first container 24 to return to its original position inside the lower compartment 18. The second container 28 can be movable in the second direction automatically upon the door 20 reaching the open position.

In the example shown, the engagement member 36 is a curved locking nub, though other shapes and configurations can be provided. In this example, each engagement member 36 engages a slot 38 in the first container 24, as seen in FIGS. 6-7. A top view of the first container 24 with the engagement member 36 of the second container 28 engaging the first container 24 is shown in FIG. 6. This top view shows an example of when the engagement member 36 engages the at least one slot 38 in the first container 24. The at least one slot 38 is configured to mate with each corresponding engagement member 36. This example shows that the engagement member 36 protrudes through the slot 38. The slot 38 can have a size that is relatively larger than the engagement member 36. As the second container 28 begins to move, the ends of the slot 38 provide a point of contact between the engagement member 36 and the first container 24. The point of contact allows movement of the second container 28, such as by the door, to be translated to the first container 24. Thus, the engagement member 36 can pull or move the first container 24. Only one engagement member 36 needs to be provided, or alternatively, multiple engagement members 36 can be used with multiple corresponding slots 38. In further examples, the slot and the engagement members can have various shapes. In the example of FIG. 6, the slot 38 provides an opening in the bottom floor of the first container 24. It is appreciated that in other examples, the slot is only accessible from one side such that the first container 24 has a continuously solid bottom floor. In examples where the first container 24 and the second container 28 are located side-by-side or in other orientations, the engagement member and/or the slot can be located on any sidewall of the container.

A side view of the engagement member 36 of the second container 28 engaging the first container 24 is shown in FIG. 7. This view is similar to FIG. 4, except that it is a sectional view showing the engagement member 36 engaging the slots 38 of the first container 24. This view shows an example arrangement of the engagement member 36 and how it engages the slots 38 of the first container 24. As in this example, the slots 38 can provide additional space for varying sized engagement members 36. The engagement members 36 are in contact with the edge of the slots 38 so as to translate movement of the second container 28 to the first container 24.

If the second container 28 is the selected container when the door 20 is in the closed position of FIG. 2, only the second container 28 is moved outwards from the lower compartment 18 of the refrigerator-freezer 10, as seen in FIG. 8. As one alternative, the user can still have the second container 28 placed in a raised position once the second container 28 moves out of the compartment, as shown in FIG. 9. This can provide improved accessibility for the second container 28. In other examples, the second container 28 can automatically be placed in the raised position of FIG. 9 upon the second container 28 being the selected container. In other examples, the second container 28 can be moved partially in the second direction while the door 20 is in the closed position so that the second container 28 is in the raised position of FIG. 9 as soon as the door 20 is placed in the open position. A partial movement in the second direction for the second container 28 can improve the accessibility of the second container 28 as a user does not have to bend down as far to reach the second container 28. The door 20 can be opened automatically or manually. In another example, the second container 28 can automatically be placed in the raised position of FIG. 9 upon the first container 24 being moved or manually moved inside the lower compartment 18.

Figure 10:
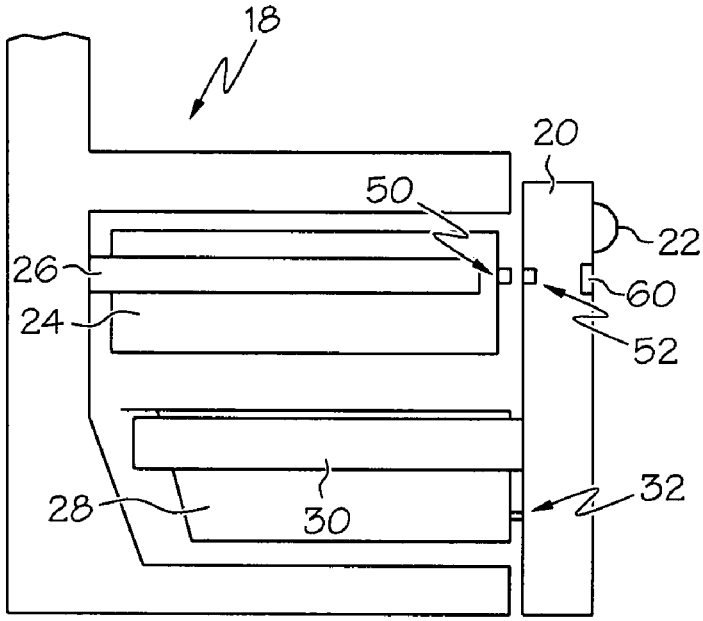
FIG. 10 is a partial view of FIG. 1 that includes a second example of the subject invention with the first container in an unlatched position.

FIGS. 10-13 show a second example of the subject invention. In the second example, the lower compartment 18 of FIG. 1 in FIG. 10 is shown. The lower compartment 18 includes a first container 24 and a second container 28 located within the compartment. The first container 24 can be an upper container and the second container 28 can be a lower container, meaning that the second container 28 can be located below the first container 24. In other examples, the first container 24 can be located in different locations relative to the second container 28, such as the first container 24 being located side-by-side with the second container 28 or the first container 24 being located at different vertical and horizontal distances from the second container 28. In FIG. 10, the second container 28 is in an original resting position.

The first container 24 is configured to be movable in a first direction. The first direction can be a horizontal direction, though other directions such as a vertical, a diagonal, or a curved line of direction can be used. The second container 28 is configured to be moveable in the first direction but can also be configured to be moveable in a second direction. In the example of FIG. 10, the first direction that the first container 24 and the second container 28 are moveable in is horizontal, as seen when comparing FIG. 10 and FIG. 12 as the first container 24 and the second container 28 are moved horizontally out of the lower compartment 18. The second direction that the second container 28 can be moveable in is vertical, which would be similar to the first example of FIGS. 2-5. In another example, the second direction can be a horizontal direction while the first direction is a vertical direction. In another example, the second direction can be a diagonal line of direction and the first direction can be a different diagonal line of direction. In yet another example, the first direction and the second direction can be different curved lines of direction. In further examples, the first direction and the second direction can each be any line of direction, such as a vertical, a diagonal, or a curved line of direction.

As seen in FIG. 10, the first container 24 can be operably connected to a first set of rails 26, such as a set of slide rails. The first container 24 in this example is movable in the first direction along the first set of rails 26. The first set of rails 26 are connected to the sidewalls of the lower compartment 18. The second container 28 is movable in the first direction along a second set of rails 30, such as a set of slide rails. The second set of rails 30 can also be connected to the sidewalls of the lower compartment 18. In the example of FIG. 10, the first set of rails 26 and the second set of rails 30 allow horizontal movement of the first container 24 and the second container 28. In other examples, the first set of rails 26 and the second set of rails 30 can be oriented in varying directions to allow varying directional movements.

Figure 12:
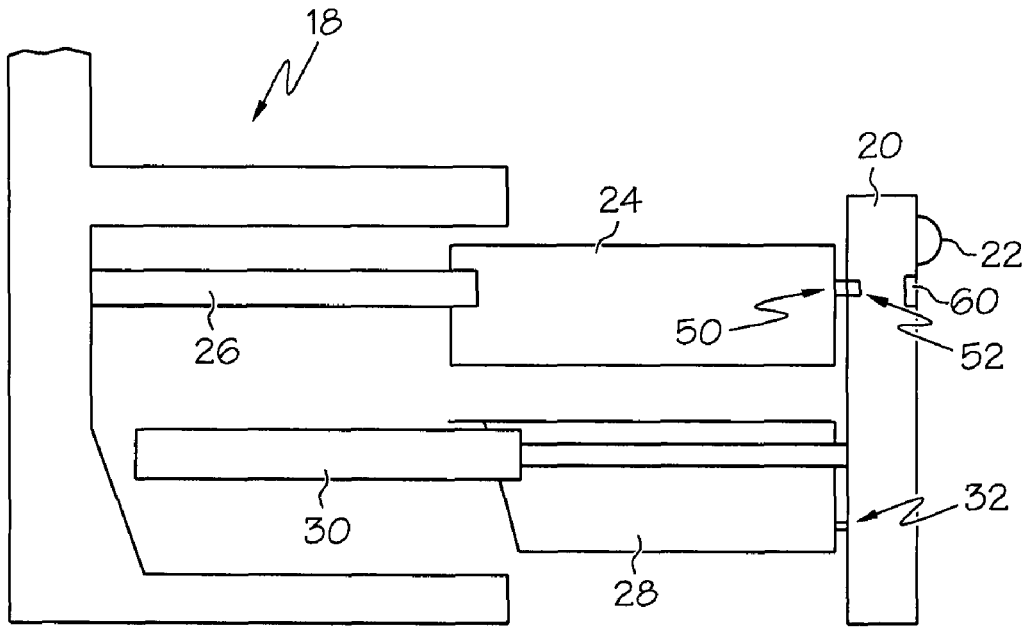
FIG. 12 is a view similar to FIG. 11 with the door in an open position.
Figure 13:
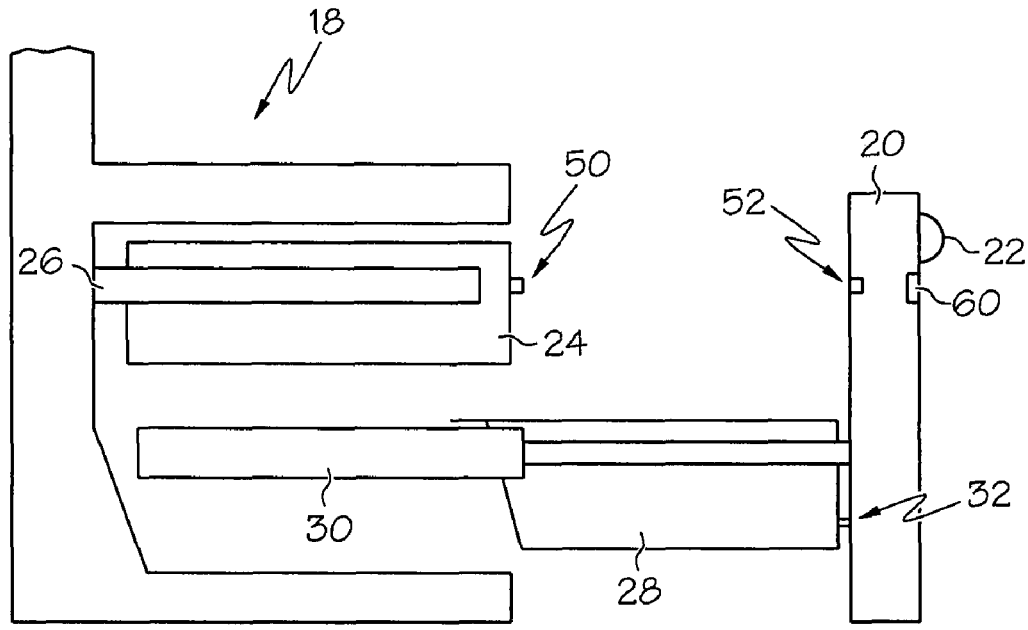
FIG. 13 is a view similar to FIG. 12 with the door in an open position and the first container located in the compartment.

The lower compartment door 20 of the lower compartment 18, seen in FIG. 10, is configured to provide access to at least one of the first container 24 and the second container 28 when the lower compartment door 20 is in an open position (FIGS. 12-13). The lower compartment door 20 is also configured to inhibit access to the first container 24, the second container 28 and the lower compartment 18 in a closed position (FIGS.

10-11). When the lower compartment door 20 is in the closed position, this inhibits access to the containers and the compartment as the containers and the compartment cannot be physically accessed by a user. The lower compartment door 20 can be movable in the first direction when moving from the closed position to the open position. The first direction of movement for the compartment door 20 can be a horizontal direction, though other directions such as a vertical, a diagonal, or a curved line of direction can be used. The second container 28 can be integrally formed with the lower compartment door 20. For example, one of the walls of the second container 28 can be the inner surface of the lower compartment door 20. Alternatively, the second container 28 can be operably connected to the door 20 for the second container 28 to move in the first direction along with the door 20. The second container 28 can be operably connected to the door by the use of at least one attachment member. In the example of FIG. 10, a first attachment member 32 is visible. The first attachment member 32 is used to connect the second container 28 to the door 20. It is appreciated that additional attachment members can also be provided. The second container 28 is connected to the door 20 for the second container 28 to move in the first direction, such as horizontally, along with the door 20.

In the example of FIG. 10, a selection of either the first container 24 or the second container 28 while the door 20 is in the closed position can be made where the selected container is presented in an accessible position. The accessible position of a container is a position where the user can physically move or remove items from the container, as the container is at least partially moved outwards from its compartment, and the door is in an open position. One example of an accessible position for the first container 24 is shown in FIG. 12. One example of an accessible position for the second container 28 is shown in FIG. 13. The selection of either container can be made while the door 20 is in the closed position. The selection device 60 is configured for inputting a selection of either the first container 24 or the second container 28 to present the selected container in an accessible position. For example, while the door 20 is in the closed position, a user can input a selection to the refrigerator-freezer 10 as to whether the first container 24 or the second container 28 will be selected for presentation.

The selection device 60 can be located on any portion of the refrigerator-freezer and can be formed of various structures, as already described. The selection device 60 is configured for inputting a selection of either first container 24 or the second container 28 to present the selected container in an accessible position. It is appreciated that in the example shown, the selected container is either the first container 24 or the second container 28, but in other examples, additional containers can be used.

Once the selection of a container is inputted to the refrigerator through the selection device 60, the selection device 60 can trigger an automatic movement of the lower compartment door 20 to an open position in one example through the control of a motor to open and close the lower compartment door 20. Upon the door reaching the open position, either by automatic or manual opening of the door, a selected container (e.g. first container 24 or second container 28) will be presented automatically to the user in an accessible position. In the examples shown, the lower compartment door 20 is pulled outwards with the selected container in an accessible position. In other examples, a door may open in other manners, such as a door connected on a hinge, where the selected container can be automatically moved out of the lower compartment 18 of the appliance automatically upon the door being placed in an open position.

In one example, the selection device 60 can include a latch 50 located on the first container 24. If the first container 24 is selected for presentation in the example of FIG. 10, the latch 50 can be activated by the selection device 60 to cause the first container 24 to be movable with the door 20. The selection device 60 can further include a selectively activated latch portion 52 that is located on the lower compartment door 20. Activation of the selectively activated latch portion 52 causes the selectively activated latch portion 52 to engage the latch 50 and secures the first container 24 to the door 20. Activation of the selectively activated latch portion 52 also causes the first container 24 to be movable with the door 20 when the door 20 moves from the closed position to the open position. In one example, the selectively activated latch portion 52 includes a corresponding magnet located within the door 20. Activation of the magnet causes the latch 50 to be connected to the selectively activated latch portion 52. In other examples of the latch 50, the latch 50 is a mechanical latch where activation of the latch 50 results in a mechanical interlocking between the latch 50 and the selectively activated latch portion 52. It is appreciated that the locations of the latch 50 and the selectively activated latch portion 52 can be varied while still enabling a selective presentation of the first container 24 or the second container 28. In another example of the latch 50, the latch 50 can include a solenoid actuated structure.

Figure 11:
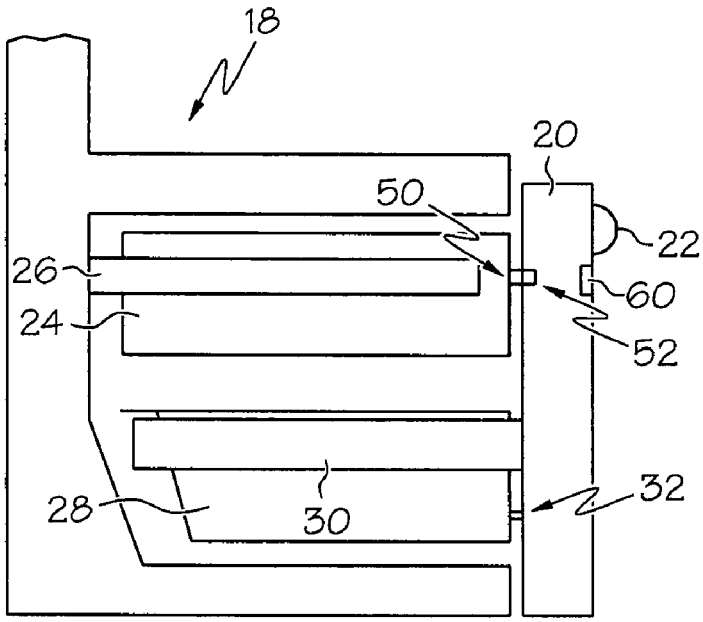
FIG. 11 is a view similar to FIG. 10 with the first container in a latched position.

The first container 24 is in an example unlatched position in FIG. 10. It is appreciated that other positions of the first container 24 are also appreciated. Activation of the selectively activated latch portion 52 causes the first container to move into a latched position, seen in FIG. 11 and FIG. 12. FIG. 11 shows the example of FIG. 10 with the selectively activated latch portion 52 activated. FIG. 12 shows the example of FIG. 11 with the door 20 moved into an open position while the selectively activated latch portion 52 is still activated to pull the first container 24 out of the lower compartment 18.

If the second container 28 is selected for presentation, only the second container 28 is moved outwards from the lower compartment 18 of the refrigerator-freezer 10, as seen in FIG. 13. FIG. 13 shows the example of FIG. 10 when the latch 50 is not selected to be activated by the user. In other examples, a plurality of bins or containers can be provided and a user can provide input to the appliance on the selection device 60, such as a control panel, to selectively determine exactly which containers will be presented in an accessible position to the user through the use of a plurality of latches.

As one alternative, the user can still have the second container 28 move in a second direction and placed in a raised position in FIG. 13 through the addition of a lifting device 40, as seen in the first example in FIGS. 3-5. In this example, the lifting device 40 moves the second container 28 along a second direction, which in this example is a vertical direction. The lifting device 40 can also move the second container 28 in a second direction that can also be a horizontal direction, a diagonal line of direction, or a curved line of direction. This can provide improved accessibility to the second container 28 when the second container 28 is selected for presentation. As another example, if the second container 28 is the selected container, the second container 28 can automatically be placed in the raised position once the door 20 is opened. The door 20 can be opened automatically or manually. In other examples, the second container 28 can be moved partially in the second direction while the door 20 is in the closed position so that the second container 28 is in the raised position as soon as the door 20 is placed in the open position. In another example, the second container 28 can automatically be placed in the raised position of FIG. 9 upon the first container 24 being moved or manually moved inside the lower compartment 18.

The subject invention also includes examples of a method of selecting one container in a compartment of an appliance, such as a refrigerator-freezer 10, and automatically moving the selected container to an accessible position, such as a refrigerator-freezer 10. The method includes the step of providing a selection device to input a selection of either a first container 24 or a second container 28 while a door 20 is in a closed position, as seen in FIG. 2 or FIG. 10. Another step in the example method is to move the door 20 from the closed position to an open position where the selected container is in the accessible position when the door reaches the open position. The door 20 can be opened automatically or manually.

If the first container 24 is selected for presentation, the method can further include the step of moving the first container 24 and the second container 28 together along with the door 20 in a first direction from the closed position of the door 20 (see example of FIG. 2 or FIG. 10) to an open position of the door 20 (see example of FIG. 4 or FIG. 5 or FIG. 12) when the first container 24 is selected for presentation. This example method can further include the step of manually moving the first container 24 in the first direction into the lower compartment 18 when the door 20 is moved to the open position (see example of FIG. 5 and FIG. 8 or example of FIG. 12 and FIG. 13). The method can also further include the step of moving the second container 28 in a second direction, such as a vertical direction, from an original resting position to a raised position, as seen in FIG. 3. This movement can occur while the door is in the closed position. In another example method, an additional step can be included. Upon the door reaching the open position when the first container 24 is selected for presentation, the second container 28 can still be moved from the raised position to the original resting position, as seen in FIG. 5.

If the second container 28 is selected, one example includes only the second container 28 moving outwards from the lower compartment 18 of the refrigerator-freezer 10, as seen in the example of FIG. 8 or FIG. 13. In another example method, if the second container 28 is selected for presentation, an additional step can include moving the second container 28 from the original resting position to the raised position while the door is in the open position, as seen in FIG. 9. This step can improve accessibility of the second container 28.

Each of the example methods of selecting one container to be moved to an accessible position from a compartment of an appliance can involve the appliance automatically performing the method upon a selection of either a first container or a second container. For example, if a user selects the first container while the door is in the closed position, the appliance can automatically move the second container in a second direction to engage the two containers before the door is moved into an open position. In another example, a latch is automatically activated to pull a first container along with the door. Thus, not only can the door move automatically from a closed position to an open position, but the method can involve the containers moving automatically and/or various latches being activated to present the selected container in an accessible position.

The invention has been described with reference to the examples described above. Modifications and alterations will occur to others upon a reading and understanding of this specification. Examples incorporating one or more aspects of the invention are intended to include all such modifications and alterations insofar as they come within the scope of the appended claims.

What is claimed is:

1. A refrigerator comprising:

a compartment;

a first container located in the compartment and configured to be movable in a first direction;

a second container located in the compartment and configured to be movable in the first direction and a second direction from an original resting position to a raised position;

a door operably connected to the second container and configured to provide access to at least one of the first container and the second container of the compartment when the door is moved to an open position; wherein the door is configured to inhibit access to the compartment when the door is moved to a closed position; and a selection device located on the refrigerator, wherein the selection device is configured to input a selection of either the first container or the second container;

wherein the selected container is presented in an accessible position when the door is moved to the open position, the accessible position defined as the selected container extended outward from the compartment; and wherein when the first container is the selected container, the selection device is configured to trigger an automatic movement of the second container to the raised position and in engagement with the first container such that the first container is in the accessible position when the door is moved to the open position, inhibiting access to the second container.

2. The refrigerator according to claim 1, wherein:

the door is movable in the first direction when moving from the closed position to the open position; and wherein the first container is operably connected to a first set of rails in the compartment for movement in the first direction and the second container is operably connected to the door for the second container to move in the first direction along with the door.

3. The refrigerator according to claim 1, further comprising:

a lifting device configured to move the second container in the second direction.

4. The refrigerator according to claim 1, wherein:

the selection is the first container; and the second container is placed in engagement with the first container while the door is in the closed position.

5. The refrigerator according to claim 4, wherein:

the door is movable in the first direction when moving the door from the closed position to the open position;

the first container and the second container are movable with the door upon moving the door into the open position;

the second container is movable in the second direction from the raised position to return to the original resting position upon the door reaching the open position; and the first container is manually movable in the first direction when the door is moved to the open position and the second container is in the original resting position.

6. The refrigerator according to claim 1, further comprising:

a latch operably connected to the first container;

wherein the latch is configured to be selectively activated by the selection device to cause the first container to also be movable with the door when the door moves from the closed position into the open position.

7. The refrigerator according to claim 6, wherein the latch includes a corresponding magnet located on the door.

8. A refrigerator comprising:

a compartment;

a first container located in the compartment and configured to be movable in a first direction;

a second container located in the compartment and configured to be movable in the first direction and a second direction from an original resting position to a raised position;

a door operably connected to the second container and configured to provide access to at least one of the first container and the second container of the compartment when the door is moved to an open position; wherein the door is configured to inhibit access to the compartment when the door is moved to a closed position;

a selection device located on the refrigerator, wherein the selection device is configured to input a selection of either the first container or the second container;

wherein the selected container is presented in an accessible position when the door is moved to the open position, the accessible position defined as the selected container extended outward from the compartment; and at least one engagement member located on the second container that is configured for selectively engaging the first container to pull the first container out of the compartment to move the first container into the accessible position, wherein when the first container is the selected container, the selection device is configured to trigger an automatic movement of the second container to the raised position and in engagement with the first container such that the first container is in the accessible position when the door is moved to the open position, inhibiting access to the second container.

9. The refrigerator according to claim 8, wherein:

the door is movable in the first direction when moving from the closed position to the open position;

wherein the first container is operably connected to a first set of rails in the compartment for movement in the first direction and the second container is operably connected to the door for the second container to move in the first direction along with the door.

10. The refrigerator according to claim 8, further comprising:

a lifting device configured to move the second container in the second direction.

11. The refrigerator according to claim 8, further comprising:

at least one slot located on the first container and configured to mate with the at least one engagement member of the second container.

12. The refrigerator according to claim 10, wherein:

the selection is the first container; and wherein the second container is placed in engagement with the first container while the door is in the closed position.

13. The refrigerator according to claim 12, wherein:

the door is movable in the first direction when moving the door from the closed position to the open position;

the second container and the first container are movable with the door upon moving the door into the open position;

the second container is movable in the second direction from the raised position to return to the original resting position upon the door reaching the open position; and the first container is manually movable in the first direction when the door is moved to the open position and the second container is in the original resting position.

14. A refrigerator comprising:

a compartment;

a first container located in the compartment and configured to be movable in a first direction;

a second container located in the compartment and configured to be movable in the first direction and a second direction from an original resting position to a raised position;

a door operably connected to the second container and configured to provide access to at least one of the first container and the second container of the compartment when the door is moved to an open position; wherein the door is configured to inhibit access to the compartment when the door is moved to a closed position; and a selection device located on the refrigerator, wherein the selection device is configured to input a selection of either the first container or the second container;

wherein the selected container is presented in an accessible position when the door is moved to the open position, the accessible position defined as the selected container extended outward from the compartment;

wherein the door is movable in the first direction when moving from the closed position to the open position;

wherein the second container is movable with the door upon moving the door into the open position;

wherein the selection device includes a latch located on the first container and the latch is configured to be selectively activated to engage the door, wherein activation of the latch causes the first container to also be movable with the door when the door moves from the closed position into the open position; and wherein when the first container is the selected container, the selection device is configured to trigger an automatic movement of the second container to the raised position and in engagement with the first container such that the first container is in the accessible position when the door is moved to the open position, inhibiting access to the second container.

15. A method of selecting one container in a compartment of a refrigerator and automatically moving the selected container to an accessible position, comprising the steps of: providing a first container and a second container; providing a door to the compartment operably connected to the second container and configured to provide access to the selected container in the accessible position, the accessible position being defined as the selected container extended outward from the compartment; providing a selection device to input a selection of either the first container or the second container, wherein when the first container is the selected container, the selection device triggers an automatic movement of the second container from an original resting position to a raised position and in engagement with the first container; and moving the door from a closed position to an open position, wherein the selected container is in the accessible position when the door reaches the open position, such that when the first container is in the accessible position, the first container inhibits access to the second container.

16. The method of claim 15, further comprising the step of:

moving the first container and the second container together along with the door in a first direction from the closed position of the door to the open position of the door when the first container is the selected container.

17. The method of claim 16, further comprising the step of:

manually moving the first container into the compartment when the door is moved to the open position.

18. The method of claim 17, further comprising the step of:

moving the second container in a second direction from an original resting position to a raised position while the door is in the closed position when the first container is the selected container; and moving the second container in the second direction from the raised position to the original resting position upon the door reaching the open position.

19. The method of claim 15, further comprising the step of:

moving only the second container outwards from the compartment when the second container is the selected container.

20. The method of claim 15, further comprising the step of:

moving the second container from the original resting position to the raised position while the door is moved to the open position when the second container is the selected container.

* * * * *